United States Patent [19]

Helland et al.

[11] Patent Number: 4,681,830

[45] Date of Patent: Jul. 21, 1987

[54] FLUORINATED CARBON-CONTAINING DEVELOPER COMPOSITION

[75] Inventors: Randall H. Helland, Richfield; Craig A. Burton, Woodbury, both of Minn.

[73] Assignee: Minnesota Mining and Manufacturing Company, St. Paul, Minn.

[21] Appl. No.: 855,891

[22] Filed: Apr. 24, 1986

Related U.S. Application Data

[63] Continuation of Ser. No. 625,314, Jun. 27, 1984, abandoned, which is a continuation of Ser. No. 159,939, Jun. 16, 1980, abandoned.

[51] Int. Cl.[4] ..... G03G 9/08

[52] U.S. Cl. ..... 430/110; 430/903

[58] Field of Search ..... 430/110, 903

[56] References Cited

U.S. PATENT DOCUMENTS

| | | | |
|---|---|---|---|
| 3,639,245 | 2/1972 | Nelson | 430/110 |
| 4,141,849 | 2/1975 | Hasegawa | 430/109 |

*Primary Examiner*—J. David Welsh

*Attorney, Agent, or Firm*—Donald M. Sell; James A. Smith; James V. Lilly

[57] ABSTRACT

A flowable, dry powder of particles of a developing composition are provided. The compositions may be either heat- or pressure-fixable and utilize from about 0.4 to 10 parts by weight of fluorinated carbon per 100 parts by weight of a thermoplastic binder and a magnetically responsive material. The fluorinated carbon has a degree of fluorination in the range of 10% to 100% and an average diameter below about 2 microns. The developing powder compositions possess improved flow humidity resistance and provide dramatically improved copy quality.

15 Claims, 4 Drawing Figures

FLUORINATED CARBON-CONTAINING DEVELOPER COMPOSITION

This is a continuation of application Ser. No. 625,314 filed June 27, 1984, now abandoned, which was a continuation of Ser. No. 159,939 filed June 16, 1980 and now abandoned.

BACKGROUND OF THE INVENTION

This invention relates to dry powder compositions suitable for use in electrographic recording. More particularly, it relates to heat-fusible and pressure-fixable one part developing powders that contain fluorinated carbon.

Known one-part developing powder formulations used in electrographic recording may be either heat-fusible or pressure-fixable. Heat-fusible developing powders are typically fixed after image formation by raising the temperature of the powder to its melting or softening point, causing the powder particles to coalesce, flow together, and adhere to the substrate. Pressure-fixable developing powders are typically fixed after image formation by simply applying pressure to the powder particles causing them to coalesce and adhere to the substrate.

Although both types of developing powders have been widely used and have enjoyed commercial success, they suffer from certain disadvantages that are related to their physical characteristics.

For example, the flow properties and developing characteristics of such powders are affected by the nature of the carbon black used therein. It has been found, for example, that when electrically resistive carbon black is employed, the developing powder has poor flow properties (i.e., it cakes and resists flow), especially in conditions of high humidity. Generally, the images produced with such powders have poor resolution, that is they exhibit fuzzy edge definition and image "fill-in" (i.e., toner deposits inside of letters such as A, B, D, O).

Additionally, such powders frequently form clumps in conditions of high humidity that may result in streaking on the finished copy. Still further, such powders are susceptible to clogging in the development station, leading to poor development and transfer of the developing powder and, consequently, poor copy quality.

Developing powders that employ conductive carbon-black also demonstrate poor flow properties and produce images that have poor resolution. Moreover, only low concentrations (e.g., about 0.5% by weight) of such carbon black can be utilized if an electrically resistive developing powder is desired. However, low carbon black concentrations are difficult to incorporate uniformly into the powder. Moreover, electrically conductive carbon black is hydrophilic in nature and this aggravates the poor flow properties of the developing powder compositions.

The foregoing disadvantages are overcome in the present invention. This is accomplished through the incorporation of fluorinated carbon into the developing powder composition.

SUMMARY OF THE INVENTION

In accordance with the present invention there is provided a flowable, dry powder of particles that has a static conductivity of less than about $10^{-3}$ (and preferably less than about $10^{-10}$) mhos per centimeter in an electric field of 10,000 d.c. volts per centimeter. The dry powder comprises (a) from about 30 to 80 (and preferably from about 35 to 45) parts by weight of a thermoplastic binder that has a static conductivity of at most $10^{-12}$ mhos per centimeter, said binder being selected from the group consisting of waxes that have a melting point in the range of about 45° C. to 150° C. (preferably between about 65° C. and 125° C.), organic resins that have a softening point above about 60° C. (preferably between about 120° C. and 200, C.), and mixtures of said waxes and resins; and correspondingly, from about 70 to 20 (and preferably from about 65 to 55) parts by weight of a magnetically responsive material; and (b) from about 0.4 to 10 parts by weight per 100 parts by weight of (a) of fluorinated carbon that has a degree of fluorination in the range of 10% to 100% (based upon the weight of the carbon) and an average diameter below about 2 microns, and preferably below about 100 millimicrons.

The fluorinated carbon may be in a radially dispersed layer or zone around the outer portions of the powder particles, or, alternatively, it may be incorporated substantially uniformly throughout the powder particles. In the former instance, the fluorinated carbon preferably comprises from about 0.75 to 3 parts, and most preferably from about 0.75 to 1.5 parts, by weight per 100 parts by weight of (a), and is from about 15% to 30% fluorinated. In the latter instance, the fluorinated carbon preferably comprises from about 0.75 to 10 parts, and most preferably from about 8 to 10 parts, by weight per 100 parts by weight of (a), and is from about 50% to 70% fluorinated.

That static conductivity referred to herein is measured according to the technique described at column 3, line 54 column 4, line 47 of U.S. Pat. No. 3,639,245. The melting point referred to above is measured according to ASTM: D-127, while the ring and ball softening point is measured according to ASTM: E28.

The powder of the present invention preferably comprises essentially spherical particles where at least 95 number percent of the particles have a maximum dimension in the range of about 4 to 30 microns.

The developing powder of the present invention possesses improved flow properties and provides high resolution images. Thus, it does not significantly cake together even in conditions of high humidity. Additionally, the images produced are uniform, have sharp edge definition, and exhibit virtually no image fill-in. Still further, backgrounding, i.e., background coloration caused by random deposition of developing powder particles in non-image area, is substantially reduced.

These results are achieved through the use of fluorinated carbon to at least partially replace standard carbon black. Fluorinated carbon is less conductive than equivalent non-fluorinated carbon black. Consequently, a higher percentage by weight of the fluorinated carbon can be employed to achieve a given conductivity, thereby providing better uniformity in the final developing powder.

Additionally, fluorinated carbon is hydrophobic so that the developing powders of the invention are less susceptible to the effects of moisture than are developing powders that employ standard carbon.

Still further, the developing powder compositions of the invention are more negatively charged during the copying process than are equivalent developing powders that employ non-fluorinated (i.e., standard) carbon.

Is is believed that this property accounts at least in part for the ability of the developing powder compositions of the invention to provide such high resolution images.

Although the use of fluorinated carbon in developing powder compositions has been suggested, see, for example U.S. Pat. No. 4,141,849 and Japanese application JA54-19343 published Sept. 8, 1976, the present invention represents an improvement thereover. These publications each disclose the use of graphite fluoride in two part developing powder compositions (i.e., those that comprise a toner powder and a separate carrier). The U.S. Patent specifies a minimum degree of fluorination of 50%, while the Japanese application specifies a degree of fluorination in the range of 1 to 150%, based upon the weight of the carbon. However, it has been found that such two part developing powder compositions are not satisfactory. For example, such powders must rely on the carrier particles to remove the toner powder from non-charged areas. Frequently, the carrier does not do an effective job of this thereby giving rise to a significant level of backgrounding. Furthermore, the developed images are frequently hollow, that is, solid areas are not filled in, resulting in low fidelity development. Additionally, copy quality degrades with time when two part developing powder compositions are employed. This requires that the developing composition be purged and replaced by fresh material. The developing powder composition of the present invention alleviates these problems.

BRIEF DESCRIPTION OF THE DRAWINGS

The present invention will be better understood by reference to the accompanying drawings wherein like reference numbers refer to the same elements throughout the several views, and wherein each drawing is a photomicrograph at 8X magnification. In the drawings

DETAILED DESCRIPTION OF THE INVENTION

Figure 1:
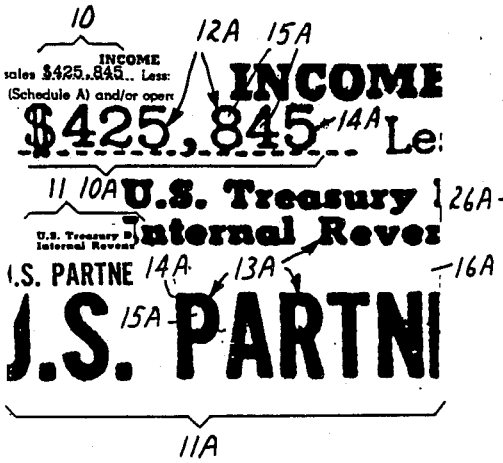
FIGS. 1 and 2 represent separate photomicrographs of copies of a graphic original containing both typed and preprinted portions. The copy in FIG. 1 was made using a heat-fusible developing powder of the invention, while the copy in FIG. 2 was made using a standard heat-fusible developing powder. Both copies were made by a conventional heat fusing copying process.
Figure 2:
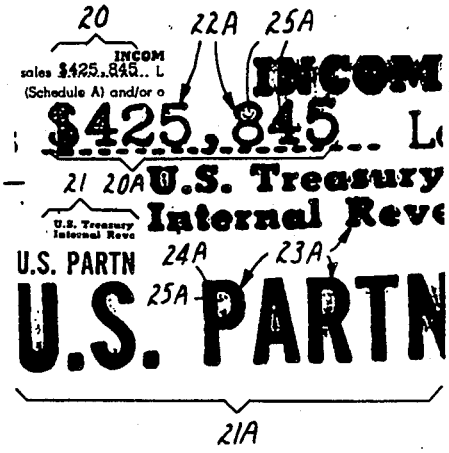

Referring specifically to FIGS. 1 and 2, there are shown portions of electrostatic copies prepared using heat-fusible developing powders and conventional copying processes. These Figures contain unmagnified typed areas 10 and 20; corresponding magnified typed areas 10A and 20A; unmagnified preprinted areas 11 and 21; and corresponding magnified preprinted areas 11A and 21A.

As can be seen by reference to areas 10A and 11A of FIG. 1, typed characters 12A and preprinted characters 13A do exhibit excellent resolution. They have well defined edges 14A and virtually no image fill-in as shown at 15A. Additionally, the copies exhibit virtually no backgrounding as shown at 16A.

The significant improvement in copy quality is shown by comparison of FIGS. 1 and 2. Thus, neither typed characters 22A nor preprinted characters 23A exhibit good resolution. To the contrary, the characters have fuzzy edges 24A and a significant level of image-fill in as shown at 25A. Furthermore, the copies exhibit a high degree of backgrounding as shown at 26A.

Figure 4:
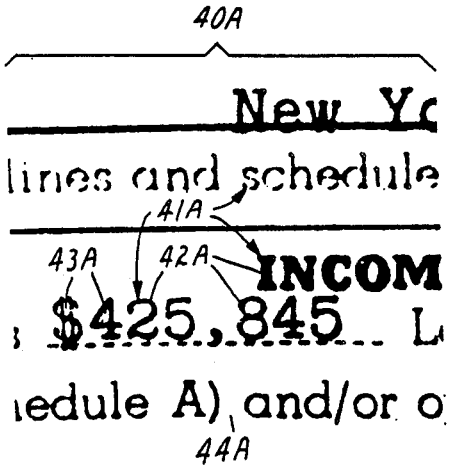
FIGS. 3 and 4 represent separate photomicrographs of copies of a graphic original containing preprinted areas. The copy in FIG. 3 was prepared using a pressure-fixable developing toner powder of the invention, while the copy in FIG. 4 was prepared using a standard pressure-fixable developing powder. Both copies were made by a conventional pressure fixing copying process.
Figure 3:
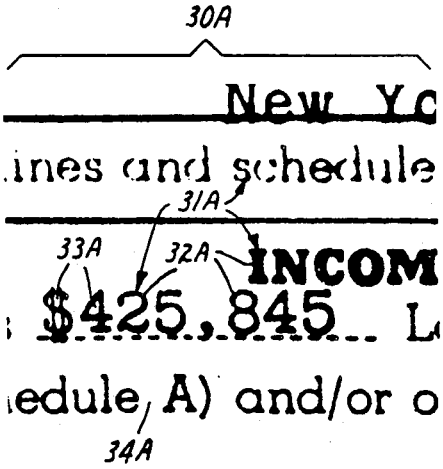

A comparison of FIGS. 3 and 4 further demonstrates the significant improvement in copy quality achieved by the developing powders of the present invention. These Figures contain magnified areas 30A and 40A.

The characters 31A in FIG. 3 have sharper edges 32A, substantially less image fill-in as shown at 33A than do characters 41A in FIG. 4. Compare, for example edges 42A and areas 43A of FIG. 4. Moreover, characters 31A are more uniformly toned than are characters 41A. See especially the a, c, d, and e.

Still further, the copy illustrated in FIGS. 1 3 demonstrate substantially less backgrounding than does the copy illustrated in FIG. 4. Compare especially areas 34A of FIG. 3 with areas 44A of FIG. 4.

These surprising results are achieved as a result of the use of fluorinated carbon in the developing powder composition of the invention. The fluorinated carbon useful in the invention comprises an inorganic compound made up of carbon chemically bonded to fluorine by covalent bonds. The fluorinated carbon may comprise fluorinated graphite (natural or artificial) or, alternatively, fluorinated petroleum coke, coal coke, charcoal, carbon black, and mixtures thereof. Such materials are known as shown by, for example, "Cermatic", 4(301) 1969; Denki Kagaku, 51, 756–761, 1963; Denki Kagaku, 35, 19–23, 1967.

Processes for the preparation of fluorinated carbon are known. For example, see "Cermatic", supra, and other references. Other process for the preparation of fluorinated carbon involve the direct fluorination of carbon at temperatures varying from ambient to over 450° C. Fluorination is preferably carried out in an agitated reactor in an atmosphere of fluorine plus an inert gas, although a non-agitated reactor may be employed if desired.

The conditions utilized during fluorination in a agitated reactor may be varied so as to obtain the desired degree of fluorination. Examples of such conditions, and the degree of fluorination obtained, are set forth in Table 1. The carbon used to obtain the data for this Table was Vulcan XC-72R, a conductive carbon black with a maximum particle size of 30 millimicron sold by Cabot Corporation.

TABLE 1

| FLUORINATION (%) | CARBON BLK (g) | RXN TIME (hrs) | RXN TEMP (°C.) | FLUORINE (cc/min) |
|---|---|---|---|---|
| 5.5 | 7.0 | 2.2 | Ambient | 40–52 |
| 15.6 | 16.5 | 31.8 | 200–210 | 5–16 |
| 20.9 | 26.3 | 2 | 200–205 | 50 |
| 24.6 | 22.7 | 7 | 150–195 | 50 |
| 31.6 | 17.6 | 6.7 | 185–200 | 11 |

Other carbon materials may also be used in the present invention. Representative of such materials are Conductex 950 (maximum particle size of 21 millimicron) sold by Cities Service, Raven 1800 (maximum particle size of 18 millimicron) sold by Columbia Chemicals, Ketjenblack EC sold by Noury, and Thermax MT sold by R. T. Vanderbilt.

The thermoplastic binder useful in the present invention has a static conductivity as set forth above and is selected from waxes that have a melting point in the range of 45° C. to 150° C. and organic resins that have a ring and ball softening point above about 60° C. Waxes useful in the invention are normally selected from the group consisting of aliphatic compounds such as waxes (natural or synthetic), fatty acids, metal salts of fatty acids, hydroxylated fatty acids or amides, low molecular weight ethylene homopolymers, or a mixture of two or more of these materials. Aromatic and polymeric wax-like materials can also be used. All of these materials are well known in the art.

Representative useful aliphatic waxes include paraffin wax, microcrystalline wax, caranauba wax, montan wax, ouricury wax, ceresin wax, candellila wax, and sugar cane wax.

Representative useful fatty acids include stearic acid, palmitic acid, and behenic acid. Representative useful metal salts of fatty acids include aluminum stearate, lead stearate, barium stearate, magnesium stearate, zinc stearate, lithium stearate, and zinc palmitate. Representative amide hydroxy waxes include N(betahydroxyethyl)-ricinoleamide (commercially available under the trade name "Flexricin 115"), N,N'ethylene-bis-ricinoleamide (commercially available under the trade name "Flexricin 185"), N(2-hydroxyethyl)-12-hydroxystearamide (commercially available under the trade name "Paracin 220"), and N,N'-ethylene-bis-12-hydroxystearamide (commercially available under the trade name "Paracin 285").

Representative fatty acid derivatives include castor wax (glyceryl tris-12-hydroxy stearate), methyl hydroxy stearate (commercially available under the trade name "Paracin 1"), ethylene glycol monohydroxy stearate (commercially available under the trade name "Paracin 15") and hydroxy stearic acid.

Representative ethylene homopolymers include the low molecular weight polyethylenes such as the Bareco Polywaxes such as Polywax 655, 1000, and 2000 sold by the Bareco Division of Petrolite Corporation. Other ethylene homopolymers include oxidized, high density, low molecular weight polyethylenes such as Polywax E-2018 and E-2020 sold by Bareco Division of Petrolite Corporation; and the Epolene ® series of low molecular weight polyethylene resins such as Epolene ® E-14 available from Eastman Chemical Products Incorporated.

Representative useful aromatic wax-like materials include dicyclohexylphthalate, diphenylphthalate and the Be Square series of waxes from the Bareco Division of Petrolite Corporation, such as Be Square 195. The Be Square waxes are high melting point waxes that consist of paraffines and naphthenic hydrocarbons.

Representative of organic resins useful as the thermoplastic binder are the polyamides (e.g., "Versamid 950", commercially available from General Mills); polystyrenes (e.g., 2000 mol. wt.); bisphenol A epoxy resins (e.g., "Epon 1004", commercially available from Shell Chemical Corp); acrylic resins (e.g., "Elvacite 2044", and N-butyl methacrylate commercially available from DuPont); vinyl resins such as polyvinyl butyral (e.g., "Butvar B72-A," commercially available from Monsanto Company), polyvinyl acetates (e.g., "Gelva V-100", commercially available from Monsanto Company); vinyl copolymers such as vinyl chloride/vinyl acetate (e.g., "VYHH", commercially available from Union Carbide Corp.), ethylene/vinyl acetate copolymers; cellulose esters such as cellulose acetate butyrate (e.g., "EAB-171-25", commercially available from Eastman Chemical Products, Inc.), cellulose acetate propionate (e.g., "CAPPLES 70", commercially available from Celanese Corp.); and cellulose ethers.

When a heat-fusible developing powder is prepared the thermoplastic binder preferably comprises the organic resin. Most preferably the organic resin has a softening point between about 120° C. and 200° C. and comprises a bisphenol A epoxy resin.

When a pressure fixable developing powder is prepared, the thermoplastic binder may comprise either the wax or a combination of the wax and the organic resin. Preferably the weight ratio of organic resin to wax is in the range of about 0:1 to 1:1. Most preferably ratio is about 0:1. In either event, the wax preferably is selected from a microcrystalline wax, a low molecular weight polyethylene resin, or a combination of both, while the organic resin, when present, comprises a bisphenol A epoxy resin.

The magnetically responsive material employed in the developing powder composition preferably is homogeneously distributed throughout the binder. Additionally, it preferably has an average major dimension of one micron or less. Representative examples of useful magnetically responsive materials include magnetite, barium ferrite, nickel zinc ferrite, chromium oxide, nickel oxide, etc.

Various other materials may also be usefully incorporated in or on the developer composition particles of the present invention. Such materials include, for example, colorants such as powdered flow agents, pigments and dyes, plasticizers, etc.

Representative powdered flow agents inclue small size $SiO_2$ such as "Cab-O-Sil" sold by the Cabot Corporation and "Aerosil" R-972 sold by the DeGussa Corporation.

Representative colorants are carbon blacks, particularly conductive carbon blacks. These may be used in conjunction with the fluorinated carbon employed in the invention.

The developing powders of the invention may be prepared by known processing techniques. Thus, for example, heat fusible developing powders may be prepared by the techniques described in U.S. Pat. No. 3,639,245 at column 5, lines 3 to 36. Pressure-fixable developing powders may be prepared by the techniques described in U.S. Pat. No. 3,925,219 at column 4, lines 25–29. Preferably the powder particles are spherical.

In these processes, the fluorinated carbon is incorporated into the developing powder in the same fashion as is the conductive particles referred to therein. The resultant powder possesses a radially dispersed layer or zone of electrically conductive carbon.

In the event that it is desired to incorporate the carbon throughout the powder particles, the carbon is added to the material of the thermoplastic binder together with the magnetite. The mixture is then processed as described in U.S. Pat. Nos. 3,639,245 and 3,925,219 to obtain the final powder particles, except that there is no embedment step.

The present invention is further illustrated by means of the following examples wherein the term "parts" refers to parts by weight unless otherwise indicated.

EXAMPLE 1

Heat-fusible developing powders were prepared using the ingredients and amounts shown:

| INGREDIENTS | PARTS 1a | PARTS 1b |
|---|---|---|
| "EPON" 1004 (Epichlorohydrin/ Bisphenol A solid epoxy resin, melting point 95°-105° C., epoxy equivalent weight 875-1,025, molecular weight of 1400 a trademarked product of Shell Chemical Company) | 40 | 40 |
| MAGNETITE (Cities Service Corporation) | 60 | 60 |
| FLUORINATED CARBON (29.6% fluorinated Vulcan XC-72R from the Cabot Corporation) | 1.3 | — |
| NON-FLUORINATED CARBON (VULCAN XC-72R) | — | 0.53 |

The "Epon" and the Magnetite were blended thoroughly on a conventional heated-roll rubber mill. The resulting blend was pulverized in an attrition-type grinder and then classified in a standard air centrifugal type machine. These particles were sharp edged and pseudocubical in shape. They were spheroidized such that most of the particles were transformed into sphere-like shapes or round-edged particles by the following process. The mixture was fed to an air aspirator in a uniform stream of about 800 grams per hour. The aspirator sucked the particles into the air stream and dispersed them forming an aerosol. The aerosol was directed at 90° into a heated air stream the temperature of which was about 510°-540° C. The powder was then allowed to settle and was collected by filtration.

The spheroidized particles were combined with either the fluorinated or the non-fluorinated carbon and then blended first at room temperature for 3 hours and then at 65° C. for about 8 hours. The carbon was then radially dispersed or embedded into the resin by the spheroidization process described above except that the temperature of the hot air stream was adjusted to 650° C. and the powder was fed to the air stream at a rate of about 36 kilograms per hour. The resultant developing powder compositions were collected and classified so that 95% by weight of the product was greater than 6.5 microns average diameter and only 5% by weight was greater than 19 microns average diameter.

The final step in the process was to blend 0.05 parts per hundred parts of developing powder composition of a small size $SiO_2$ flow agent (i.e., Aerosil R-972 sold by the DeGussa Corporation) with the composition. The resultant compositions were tested for static conductivity. The results are given in Table 2.

TABLE 2

| Example | Carbon | Static Conductivity (Mhos/cm) 1000 v/cm |
|---|---|---|
| 1a | Fluorinated | $2.3 \times 10^{-15}$ |
| 1b | Non-fluorinated | $2.7 \times 10^{-15}$ |

This data demonstrates that the use of fluorinated carbon enables a larger quantity of conductive material to be employed in the developing powder compositions in order to achieve a given static conductivity. This in turn provides improved flow characteristics even under conditions of high humidity.

Each of the developing powder compositions was used in a conventional heat fusing copying process to provide images on a plain paper substrate. The developing powder composition of Example 1a provided copies with images that were sharply defined and had virtually no image fill-in. Additionally there was virtually no backgrounding. A photomicrograph of a copy prepared from the powder of Example 1a, is shown in FIG. 1. The developing powder composition of Example 1b provided copies with images that were not sharply defined and had substantial amounts of image fill-in. Furthermore, there was a significant degree of backgrounding. A photomicrograph of a copy prepared from the powder of Example 1b is shown in FIG. 2.

EXAMPLE 2

A heat-fusible developing powder composition was prepared as described in Example 1 except that embedment was carried out at 430° C. The following ingredients and amounts shown were used.

| INGREDIENTS | PARTS |
|---|---|
| "EPON" 1004 | 40 |
| MAGNETITE | 60 |
| FLUORINATED CARBON (63% Fluorinated Graphite sold by Air Products and Chemicals, Inc.) | 0.57 |
| NON-FLUORINATED CARBON (Vulcan XC-72R) | 0.57 |

The resultant developing powder composition was classified so that 95% by weight of the powder was greater than 8 microns average diameter and only 5% by weight was greater than 20 microns average diameter. The static conductivity of the developing powder was $2.8 \times 10^{-15}$ mhos/cm in a 10,000 volt/cm d.c. field. The developing powder was used in a heat fusing copying process to provide a copy with well defined images and virtually no image fill-in or backgrounding on a plain paper substrate.

EXAMPLE 3

Heat-fusible developing powder compositions were prepared using the following ingredients in the amounts shown.

| INGREDIENTS | PARTS 3a | PARTS 3b |
|---|---|---|
| "EPON" 1004 | 37.5 | 40 |
| MAGNETITE | 62.5 | 60 |
| FLUORINATED CARBON (63% Fluorinated Graphite sold by Air Products and Chemicals, Inc.) | 4.2 | — |

The ingredients were blended thoroughly on a conventional heated-roll rubber mill. The resulting material was pulverized in an attrition-type grinder and was then classified so that 95% by weight of the powders were greater than 7 microns average diameter and only 5% by weight were greater than 20 microns average diameter. Classification was carried out in a standard air centrifugal type machine. The particles were then blended with 0.05 parts per hundred parts of developing composition of a small size $SiO_2$ flow agent.

The static conductivities of the developing powders are given in Table 3.

TABLE 3

| Example | Carbon | Static Conductivity (mhos/cm) 10,000 v/cm |
|---|---|---|
| 3a | Fluorinated | $5 \times 10^{-15}$ |
| 3b | None | $1.4 \times 10^{-15}$ |

Each of the developing powder compositions was used in a heat fusing copying process to provide images on a plain paper substrate. The developing powder composition of Example 3a provided copies with images that were sharply defined and had virtually no image fill-in. Additionally there was virtually no backgrounding. The developing powder composition of Example 3b provided copies with images that were not sharply defined and had substantial amounts of image fill-in. Furthermore, there was substantial backgrounding.

EXAMPLE 4

Example 1 was repeated except that embedment was carried out at about 430° C. In Example 4a, 0.49 parts by weight of fluorinated Vulcan XC-72R (8.4% fluorination) was employed, while in Example 4b, 0.42 parts by weight of non-fluorinated Vulcan XC-72R was used. The static conductivity of the resultant developing powder compositions is reported in Table 4.

TABLE 4

| Example | Carbon Black | Static Conductivity (mhos/cm) 10,000 v/cm |
|---|---|---|
| 2a | Fluorinated | $5.5 \times 10^{-15}$ |
| 2b | Non-fluorinated | $9.0 \times 10^{-15}$ |

When each of these compositions was employed in a heat fixing copying process to produce images on a plain paper substrate, no difference could be seen between the quality of the copies produced. Thus, in each case the images had poor edge definition and a fair degree of image fill-in. Consequently, this example demonstrates that the fluorinated carbon must have a degree of fluorination of at least 10%.

EXAMPLE 5

Pressure-fixable developing powders were prepared using the following ingredients in the amounts stated:

| INGREDIENTS | PARTS 5a | PARTS 5b |
|---|---|---|
| POLYWAX E2018 (Oxidized high density, molecular weight polyethylene sold by Bareco Division of Petrolite Corporation) | 10 | 10 |
| BE SQUARE 195 (Hard microcrystalline wax sold by Bareco Division of Petrolite Corporation) | 30 | 30 |
| MAGNETITE | 60 | 60 |
| FLUORINATED CARBON (29.4% fluorinated Conductex 950 from Columbia Carbon) | 1.8 | |
| NON-FLUORINATED CARBON (Conductex 950) | — | 1.8 |

The Polywax and the Be Square were first heated to melting after which the magnetite was added, with stirring, and heated until a homogeneous dispersion was obtained. The temperature of the dispersion was raised to 193° C. and then sprayed through a nozzle at a rate of about 91 kg/hr to form discrete particles. The particles were classified so that 95% by weight were greater than 6.5 microns and no more than 5% by weight were greater than 20 microns in average diameter.

The substantially spherical particles were then combined with the fluorinated or non-fluorinated carbon black and blended for 3 hours at room temperature. The particles were then spheoridized and the carbon embedded therein as described in Example 1. Embedment was carried out at about 430° C.

The developing powder compositions were then classified so that 95% by weight of the powder was greater than 6.5 microns average diameter and only 5% by weight was greater than 20 microns average diameter. The static conductivities of these developing powder compositions were measured and are reported in Table 5.

TABLE 5

| Example | Carbon Black | Static Conductivity (Mhos/cm) 10,000 v/cm |
|---|---|---|
| 5a | Fluorinated | $2 \times 10^{-10}$ |
| 5b | Non-fluorinated | $>10^{-4}$ |

Each of the developing powder compositions was used in a pressure fixing copying process to provide images on a plain paper substrate. The developing powder composition of Example 5a provided copies whose images were sharply defined and had virtually no image fill-in. Moreover, the copies had virtually no backgrounding. A photomicrograph of a copy prepared using the developing powder of Example 5a is shown in FIG. 3. The developing powder composition of Example 5b, on the other hand, provided copies whose images had poor edge definition and a high degree of image fill-in. Additionally, the background areas of the copies produced from the developing powder composition of Example 5b had a high degree of backgrounding. A photomicrograph of a copy prepared using the developing powders of Example 5b is shown in FIG. 4.

EXAMPLE 6

Example 5 was repeated except that Vulcan XC-72R (1.6 parts by weight) that had a degree of fluorination of 20.8% was utilized in Example 6a and 0.62 parts by weight of non-fluorinated Vulcan XC-72R was used in Example 6b. The developing powder compositions were classified so that 95% by weight of the powder was greater than 8 microns average diameter and only 5% by weight was greater than 20 microns average diameter. The static conductivity of the resultant developing powder compositions is reported in Table 6.

TABLE 6

| Example | Carbon Black | Dynamic Conductivity (Mhos/cm) 10,000 v/cm |
|---|---|---|
| 6a | Fluorinated | $2 \times 10^{-11}$ |
| 6b | Non-fluorinated | $3 \times 10^{-10}$ |

Each of the developing powder compositions was used in a pressure-fixing copying process to provide images on a plain paper substrate. The developing powder composition of Example 6a provided copies whose images were sharply defined and had virtually no image fill-in. The copies exhibited little backgrounding. The developing powder composition of Example 6b provided copies whose images were not sharply defined and had substantial amounts of image fill-in. The copies exhibited substantial backgrounding.

EXAMPLE 7

Example 5 was repeated using the following ingredients in the amounts shown:

| INGREDIENTS | PARTS 7a | PARTS 7b |
|---|---|---|
| POLYWAX E2018 | 10 | 10 |
| BE SQUARE 195 | 30 | 30 |
| MAGNETITE | 60 | 60 |
| FLUORINATED CARBON (Vulcan XC-72R, 13.8% fluorination) | 1.24 | — |
| NON-FLUORINATED CARBON (Vulcan XC-72R) | — | 0.62 |

The developing powder compositions were classified so that 95% by weight of the powder was greater than 8 microns average diameter and only 5% by weight was greater than 20 microns average diameter. The static conductivity of the resultant developing powder compositions is reported in Table 7.

TABLE 7

| Example | Carbon Black | Static Conductivity (Mhos/cm) 10,000 v/cm |
|---|---|---|
| 7a | Fluorinated | $8 \times 10^{-11}$ |
| 7b | Non-fluorinated | $3 \times 10^{-10}$ |

Each of the developing powder compositions was used in a pressure fixing copying process to provide images on a plain paper substrate. The developing powder composition of Example 7a provided copies whose images were sharply defined and had virtually no image fill-in. The copies exhibited little backgrounding. The developing powder composition of Example 7b provided copies whose images were not sharply defined and had substantial amounts of image fill-in. The copies also exhibited substantial backgrounding.

EXAMPLE 8

Example 5 was repeated using the following ingredients in the amounts shown:

| INGREDIENT | PARTS 8a | PARTS 8b |
|---|---|---|
| POLYWAX 1000 (A low molecular weight, unmodified homopolymer of ethylene having a $M_w/M_m$ of 1.2 sold by Bareco Division of Petrolite Corp.) | 42 | 42 |
| MAGNETITE | 58 | 58 |
| FLUORINATED CARBON (25.6% fluorinated Vulcan XC-72R) | 1.54 | — |
| NON-FLUORINATED CARBON (Vulcan XC-72R) | — | 0.62 |

The resultant developing powder compositions were collected and classified so that 95% by weight of the products were greater than 8 microns average diameter and only 5% by weight were greater than 20 microns average diameter. The dynamic conductivities of the resultant compositions are reported in Table 8.

TABLE 8

| Example | Carbon | Dynamic Conductivity (mhos/cm) 10,000 v/cm |
|---|---|---|
| 8a | Fluorinated | $1.9 \times 10^{-15}$ |
| 8b | Non-Fluorinated | $1.5 \times 10^{-15}$ |

Each of the developing powder compositions was used in a heat fusing copy process to provide images on a plain paper substrate. The developing powder composition of Example 8a provided copies whose images were sharply defined and had virtually no image fill-in. The copies exhibited very little backgrounding. The developing powder composition of Example 8b provided copies whose images were not sharply defined and had substantial amounts of image fill-in. The copies also exhibited substantial backgrounding.

EXAMPLE 9

A pressure-fixable developing powder was prepared as described in Example 5 using the following ingredients in the amounts shown:

| INGREDIENTS | PARTS |
|---|---|
| POLYWAX 1000 | 10 |
| EPOLENE ® E-14 (emulsifiable low molecular weight polyethylene resin available from Eastman Chemical Products, Incorporated) | 30 |
| MAGNETITE | 60 |
| FLUORINATED CARBON (25.6% fluorinated Vulcan XC-72R) | 1.05 |

The resulting developing powder composition was collected and classified so that 95% by weight of the product was greater than 9 microns average diameter and only 5% by weight was greater than 22 microns average diameter. The composition had a dynamic conductivity of $5.3 \times 10^{-13}$ Mhos/cm in a 10,000 volt/cm electric fold. The composition was used in a heat fusing copy process to provide images on a plain paper substrate and provided copies whose images were sharply defined and exhibited virtually no image fill-in. Furthermore, the copies exhibited very little backgrounding.

What is claimed is:

1. A flowable, dry powder of particles that has a static conductivity of less than about $10^{-3}$ mhos per centimeter in an electric field of 10,000 d.c. volts per centimeter comprising (a) from about 30 to 80 parts by weight of a thermoplastic binder that has a static conductivity of at most about $10^{-12}$ mhos per centimeter, said binder being selected from the group consisting of waxes that have a melting point in the range of about 45° C. to 150° C., organic resins that have a softening point above about 60° C., and mixtures of said waxes and said resins; and correspondingly, from about 70 to 20 parts by weight of a magnetically responsive material and (b) from about 0.4 to 3 parts by weight per 100 parts by weight of component (a) of fluorinated carbon that has a degree of fluorination in the range of 15% to 30% and an average diameter below about 2 microns, wherein said fluorinated carbon comprises a radially dispersed zone around the outer portions of said particles and wherein said fluorinated carbon renders said dry powder more negatively chargeable.

2. A powder in accordance with claim 1 that has a static conductivity less than about $10^{-10}$ mhos per centimeter in an electric field of 10,000 d.c. volts per centimeter.

3. A powder in accordance with claim 1 wherein at least about 95 number percent of said particles have a maximum dimension in the range of about 4 to 30 microns.

4. A powder in accordance with claim 1 wherein said particles are essentially spherical.

5. A powder in accordance with claim 1 wherein said fluorinated carbon has an average diameter of below about 100 millimicrons.

6. A powder in accordance with claim 1 wherein said fluorinated carbon comprises from about 0.75 to 3 parts by weight per 100 parts by weight of component (a).

7. A powder in accordance with claim 1 wherein the weight ratio of said organic resin to said wax in said binder is in the range of about 0:1 to 1:1, and wherein said powder is pressure-fixable.

8. A powder in accordance with claim 7 wherein said binder is said wax.

9. A powder in accordance with claim 8 wherein said binder is selected from low molecular weight polyethylene, mixtures of low molecular weight polyethylenes, and mixtures of low molecular weight polyethylene with aromatic waxes.

10. A powder in accordance with claim 1 wherein said binder comprises said organic resin and wherein said powder is heat-fusible.

11. A powder in accordance with claim 10 wherein said organic resin comprises a bisphenol A epoxy resin.

12. A powder in accordance with claim 1 wherein said fluorinated carbon comprises fluorinated carbon black.

13. A powder in accordance with claim 1 wherein said fluorinated carbon comprises graphite fluoride.

14. A powder in accordance with claim 6 wherein component (a) comprises from about 35 to 45 parts by weight of said thermoplastic binder, and, correspondingly, from about 65 to 55 parts by weight of said magnetically responsive material.

15. A one part developing powder composition comprising (a) particles containing a mixture of a thermoplastic binder and a magnetically responsive material, and (b) a radially dispersed layer of a fluorinated carbon having a degree of fluorination in the range of 15 to 30% and an average diameter below about 2 microns embedded in the surface of said particles wherein said composition is capable of being more negatively charged during electrostatic copying processes than is a developer which is identical to said composition but which employs non-fluorinated carbon in place of said fluorinated carbon, and wherein said composition contains from 35 to 45 parts by weight of said thermoplastic binder having a static conductivity of at most $10^{-12}$ mhos per centimeter, correspondingly from 65 to 55 parts by weight of said magnetically responsive material, and from 0.75 to 1.5 parts by weight of the combined weight of said binder and said magnetically responsive material of said fluorinated carbon.

* * * * *